US006612485B2

(12) United States Patent
Lackner et al.

(10) Patent No.: US 6,612,485 B2
(45) Date of Patent: Sep. 2, 2003

(54) FOOD CONTAINER WITH CONDIMENT CONTAINER SUPPORT AND METHOD FOR MAKING FOOD CONTAINER WITH CONDIMENT CONTAINER SUPPORT

(75) Inventors: Nicholas F. Lackner, Pittsburgh, PA (US); Adam M. Shestak, Pittsburgh, PA (US)

(73) Assignee: Paper Products Co., Inc., Pittsburgh, PA (US)

( * ) Notice: Subject to any disclaimer, the term of this patent is extended or adjusted under 35 U.S.C. 154(b) by 0 days.

(21) Appl. No.: 10/185,160

(22) Filed: Jun. 28, 2002

(65) Prior Publication Data

US 2003/0006274 A1 Jan. 9, 2003

Related U.S. Application Data

(60) Provisional application No. 60/303,524, filed on Jul. 6, 2001.

(51) Int. Cl.[7] ..... B65D 3/24

(52) U.S. Cl. ..... 229/400; 220/23.83; 220/738; 229/902; 493/128; 493/152

(58) Field of Search ..... 229/400, 902, 229/904, 906; 220/23.4, 23.83, 737, 738; 493/128, 129, 130, 131, 152

(56) References Cited

U.S. PATENT DOCUMENTS

| | | | | |
|---|---|---|---|---|
| 2,856,113 A | * | 10/1958 | Brumby et al. | 229/400 |
| 4,491,220 A | * | 1/1985 | Daviss | 220/23.4 |
| 4,620,631 A | | 11/1986 | Bartlet | |
| 5,137,210 A | | 8/1992 | Hibbs | |
| 5,417,364 A | | 5/1995 | Shaw | |
| 5,720,429 A | | 2/1998 | Cordle | |
| 5,775,570 A | | 7/1998 | Kim | |
| 5,875,957 A | | 3/1999 | Yocum | |
| 6,102,208 A | * | 8/2000 | Huang | 229/904 |
| 6,152,362 A | | 11/2000 | Rosenfeld | |
| 6,193,201 B1 | | 2/2001 | Babcock | |
| 6,216,946 B1 | | 4/2001 | Cai | |
| 6,230,969 B1 | * | 5/2001 | Spransy | 229/400 |
| 6,349,874 B1 | | 2/2002 | Hill | |
| 6,360,944 B1 | | 3/2002 | Gorman | |

* cited by examiner

*Primary Examiner*—Gary E. Elkins
(74) *Attorney, Agent, or Firm*—Paul A. Beck & Assoc.

(57) ABSTRACT

A food container with an integral loop member for securely holding a condiment container, allowing the two to be transported as one item. The container is formed from a first portion of a blank and has a continuous lip. The loop member is formed from a second portion of the blank and distinct from the first portion of the blank. The loop extends from an exterior surface of the container and no part of the loop member contacts the lip. A method for forming the container from one blank is also disclosed.

5 Claims, 8 Drawing Sheets

FOOD CONTAINER WITH CONDIMENT CONTAINER SUPPORT AND METHOD FOR MAKING FOOD CONTAINER WITH CONDIMENT CONTAINER SUPPORT

CROSS REFERENCE TO RELATED APPLICATION

This application claims the benefit of U.S. Provisional Application No. 60/303,524 filed on Jul. 6, 2001.

BACKGROUND OF THE INVENTION

1. Field of the Invention

The invention relates to food and condiment containers typically used in fast food restaurants and similar venues.

2. Description of Problem to be Solved and the Related Art

Transportation and use of separate condiment and food containers may be manageable in an eat-in setting, however, venues that require consumers to carry and eat their food away from where it is purchased (e.g. stadiums, amusement parks, and drive-through restaurants) make the use of completely separate containers for food and condiment inconvenient and messy. Consumers desiring to use condiments on their food in such situations are generally faced with two options: a) to carry both a container full of food and a separate container for their condiment of choice, or b) to apply the condiment directly to their food. The former can be cumbersome, often requiring two hands. In the case of drive through restaurants where consumers often eat while driving this is hazardous. The latter often results in uneven condiment distribution on the food, as well as an unpleasant mess and excessive use of napkins when the condiments find themselves on the hands, clothes, and surroundings of the consumer who is forced to eat a food already covered in condiments.

A solution to this problem is to provide a food container with the ability to hold a condiment separate from the food, allowing the food and condiment to remain apart, but be easily carried together in one hand. Such a container would not only enable consumers to have a free hand with which they could dip and eat their food, but would also decrease the uneven, messy condiment distribution that often results when one applies condiments directly to food.

Prior containers have been designed to achieve this objective. U.S. Pat. Nos.: 5,137,210; 5,720,429; 5,875,957; and 6,349,874 all propose food containers with an integral pocket for holding condiments. While these containers eliminate the need for an additional condiment container and allow consumers to carry separate food and condiment in the same hand, their designs are vulnerable to spillage. If the sides of such a container were grasped or squeezed too tightly, the pocket volume would be compressed, forcing the condiment out of the top of the pocket and creating a mess.

An alternative to this design is to have a food container with the ability to hold a condiment container that would otherwise be separate. U.S. Pat. Nos.: 4,620,631; 6,152,362; and 6,193,201 attempt to employ this alternative by proposing condiment container support devices that are attached or bonded to food containers. These support devices are not formed from the same blank as the food container, requiring their attachment to the container by the manufacturer or consumer. Such attachments represent a costly modification of existing manufacturing processes for food containers, and an inconvenience to vendors and/or consumers.

The containers disclosed in U.S. Pat. Nos.: 5,417,364; 5,775,570; 6,152,362; 6,216,946; and 6,360,944 utilize food containers with integral condiment container support devices, eliminating the need for attachments. These containers all enable an originally separate condiment container to be joined to a food container. U.S. Pat. No. 5,417,364 proposes a shelf style support for a condiment container, folding outward from the sides of the food container. This design lacks support for the condiment container on the side of the shelf not attached to the food container's wall, allowing for potential spillage to occur if the food container is jarred or tilted and the condiment container slides off of the unattached end.

Incorporating a more secure holding device, U.S. Pat. Nos.: 5,775,570; 6,216,946; and 6,360,944 propose containers with integral condiment support devices that encompass condiment containers, lessening the possibility that the condiment container will separate from the food container accidentally. In U.S. Pat. No. 6,216,946, however, the manner in which the condiment container support device is deployed from its upright position creates a container wall of uneven height. Spillage of the food container's contents out of the shortened portion of the wall due to a tilting or jarring of the container is a definite possibility with such a design. U.S. Pat. Nos. 6,216,946 and 6,360,944 also extend their condiment support devices from the upper lip of the food containers. This represents a potential balance problem, as the weight of a full condiment container inserted into the support device may cause the entire structure to tip once some of the food in the container that would normally counterbalance this effect has been eaten. Furthermore, while U.S. Pat. Nos. 6,216,946 and 6,360,944 are cut from one blank, their production requires several additional cutting and scoring steps, complicating manufacture.

U.S. Pat. No. 5,775,570 incorporates an integral condiment support device that does not extend from the upper lip of the food container. The support device in this design, however, is formed from a piece of the container's wall, such that the deployment of the device results in spaces or holes in the wall of the container through which food may spill. In addition, for the support device to be deployed, a portion of the wall of this container must be pushed inward. This reduces the volume of the container. If a consumer were to fill the container with food prior to deciding that they wished to use the support device, the reduction in container volume caused by the deployment of the device would cause spillage, provided the deployment was not already made impossible by the full capacity of the container.

Although the deployment of the support device in U.S. Pat. No. 6,152,362 creates only a small slit in the wall of the container from which it is formed, the use of the support device requires an additional condiment holding piece into which the condiment container must be inserted if the support device that is an integral part of the container is to be used. This piece is separate from both the food and condiment containers, making the use of the container more costly and complicated for both manufacturers and consumers.

It is therefore desirable for a container serving the above stated purpose to not only have the integral ability to securely hold a condiment container, but also to hold that container in such a manner that the containing ability and stability of the food container is not compromised by the deployment or positioning of the condiment support device. In addition, a structure and method of production that requires few steps in addition to those already employed in the process currently used to manufacture food containers such as french fry cups and baskets is ideal.

SUMMARY OF THE INVENTION

The invention overcomes the above difficulties by proposing a food container cut from a continuous blank that has a continuous lip with an integral loop member for supporting a condiment container. The loop member, extending from the exterior surface of the food container, is closed by a lap joint at the vertical seam of the container, and does not contact the lip of the container.

Although the entire structure is formed from a continuous blank, the loop member is formed from a part of the blank distinct from the part of the blank that is used to form the containing member. No structural changes in the containing member of the invention are created by the deployment and use of the loop member. This avoids the difficulties that are apt to occur in prior art containers where the use of condiment support devices requires structural changes in the containing member.

The loop member securely holds the condiment container, even when the food container is shaken or tilted. The diameter of the loop member is such that upon insertion, the condiment container rests snuggly within the confines of the loop and exterior surface of the container. The lip of the condiment container contacts the edges of the loop member, providing more than adequate support against the downward pressure that results as a consumer dips food into the condiment container.

A loop member that does not contact the lip of the container assures that the walls of such a container can remain intact and retain their normal height when the loop member is deployed, thus protecting against the type of spillage apt to occur in prior art containers whose deployed condiment support devices detract from the height of the walls of the container. The positioning of the loop member in the proposed invention also facilitates balance of the container when it is in use. Even when the food container is empty, a full condiment container inserted into the loop member does not tip the container. This overcomes the apparent balance problems of prior art containers whose condiment support devices contacted the lip of the containers.

Closing the loop by binding one end of the loop to the container's vertical seam, forming a lap joint, is a means of forming a loop that requires minimal additions to the process already used in the manufacture of containers without loop members. Containers with any sort of vertical seam presently use an adhesive to close such a seam. By binding an end of the loop member to a vertical seam that is already going to be sealed, no extra adhesive is necessary, as the lap joint uses the adhesive already required to close the vertical seam of the container.

The entire invention of container with a loop for holding a separate condiment container can be cut from a single blank in a manner almost identical to that currently used to produce food containers without the ability to support condiment containers. Forming this invention from a single blank eliminates the additional and often costly step of attaching a separate supporting device. The only additional cutting required is that necessary to form the loop member. Although some portions of the section of material from which the blank is cut are not incorporated into the formation of the container, the manner of cutting is such that the material remaining after only two containers have been cut can be of such a dimension that two container bottoms can be cut from the discarded piece. This drastically minimizes the amount of material that will need to be recycled.

The loop member can then be pressed flush against the exterior surface of the container, allowing the containers to nest unimpeded by the loop member in a manner identical to that currently employed in the storage of multiple food containers. When the consumer is given the container, he or she only needs to push the closed loop member slightly to open it, allowing for the easy insertion of the condiment container. Testing has shown this action is easily performed. The invention can be embodied in food containers similar to those already in use, such as the french fry cup or basket.

We provide a food container comprising a containing member having an exterior surface and formed from a first portion of a blank, the containing member having a continuous lip. A loop member is formed from a second portion of the blank and distinct from the first portion of the blank and extends from the exterior surface of the container. No part of the loop member contacts the lip. The loop member is opened throughout the loop and forms an opening to receive a condiment container.

We preferably provide that the container member has a vertical seam in which the loop member is closed at the seam. The loop member is closed at the seam by binding an end of the loop to the seam to form a lap joint at the seam.

We provide that the loop member has a condiment container inserted into the loop member and is supported by the loop member.

We provide a method for making a food container having an integral condiment container comprising providing a flat container blank having an integral strip of blank material extending from the blank and below a top edge of the container blank forming the container blank into a container and joining the ends of the container blank to form a vertical seam along the container, and forming the integral strip into a loop and joining a free end of the strip at the seam to form a lap joint with the container seam and the free end of the integral strip, the loop sized to receive and support a condiment container for the food container.

DETAILED DESCRIPTION OF THE INVENTION

Definitions

"Blank" means a section of material from which a food container can be formed.

"Blank having an integral strip" means a section of material used to form a food container, which includes a strip extending from one side of that section, the strip and section being one continuous piece.

"Condiment container" means a vessel for holding condiments, commonly seen in the form of a rounded souffle cup.

"Container member" means a vessel including an exterior and interior surface of a surrounding wall or walls as well as a bottom.

"Continuous lip" means a lip whose structure is not changed by the deployment or use of any part of the container.

"Exterior surface" means the side of the container member that faces away from the rest of the container member.

"Food container" means a vessel, such as a cup or basket used to house food products.

"Lap joint at the seam" means the region of the containing member that overlaps itself in order to complete the container's closure and simultaneously affix and secure the free end of an integral strip, forming a loop member.

"Lip" means the uppermost edge of the container.

"Loop or loop member" means an apparatus for supporting a condiment container consisting of a closed perimeter of material into which the condiment container can be vertically inserted and held.

"Vertical seam" means any area where two walls or portions of the container, otherwise separate, overlap, are connected, and are sealed in a vertical manner.

Description

Figure 1:
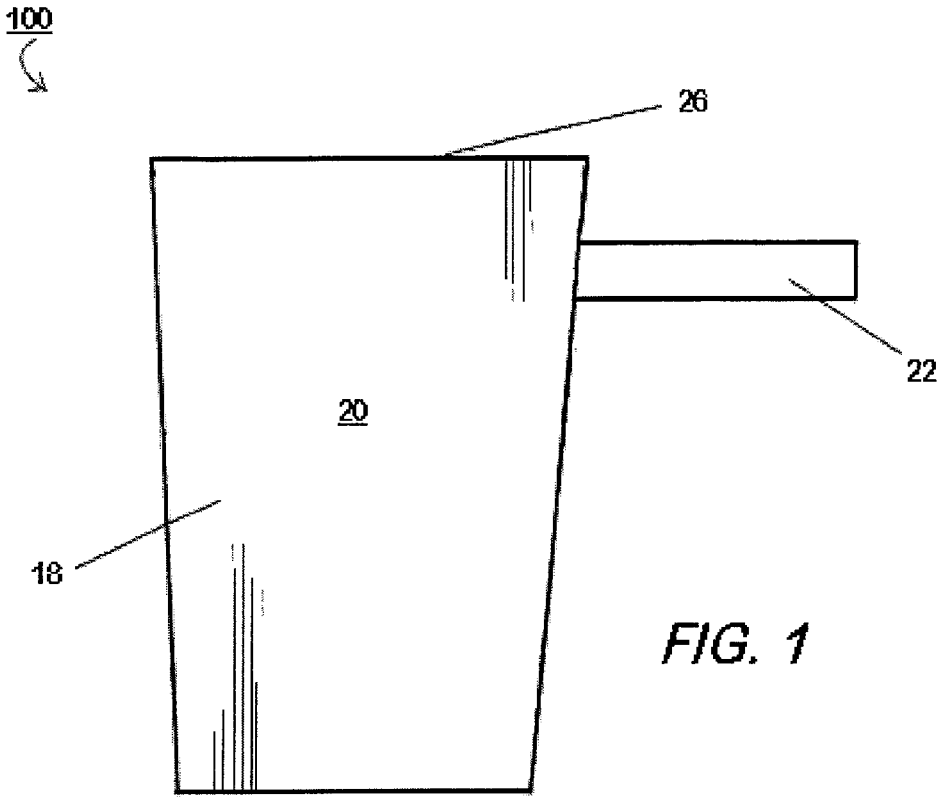
FIG. 1 A side view of a container showing the integral loop member in deployed position.
Figure 2:
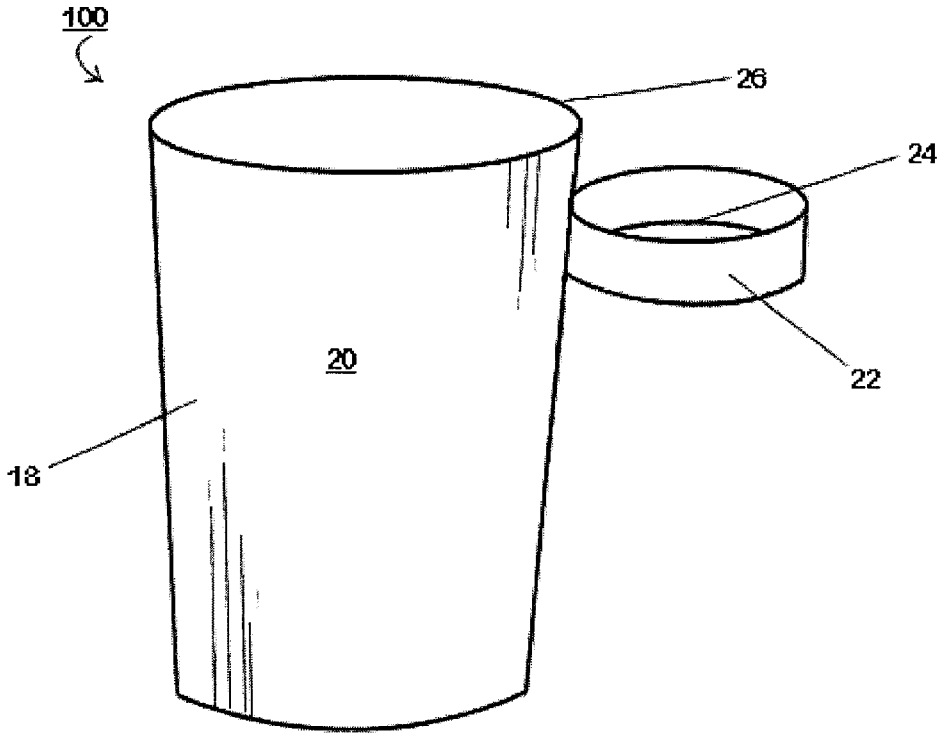
FIG. 2 A side perspective view of the container of the present invention as shown in FIG. 1.
Figure 3:
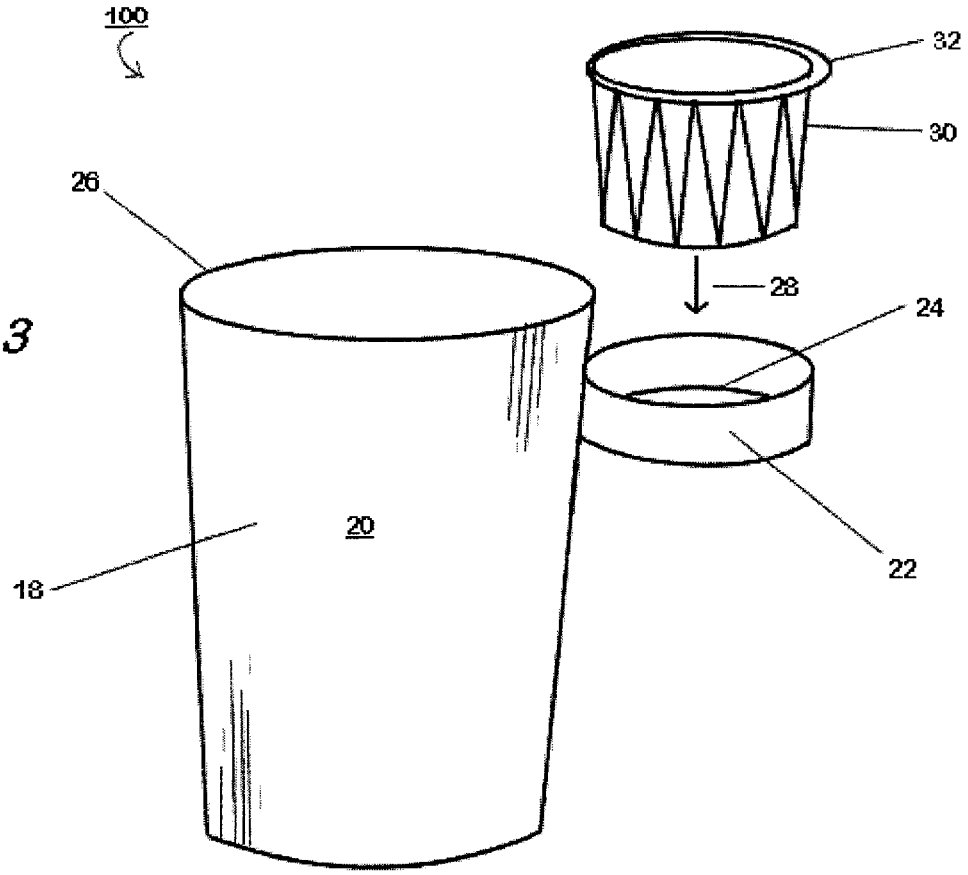
FIG. 3 A side perspective view of the container of the present invention, illustrating the manner in which a condiment container is inserted into the deployed loop member.
Figure 4:
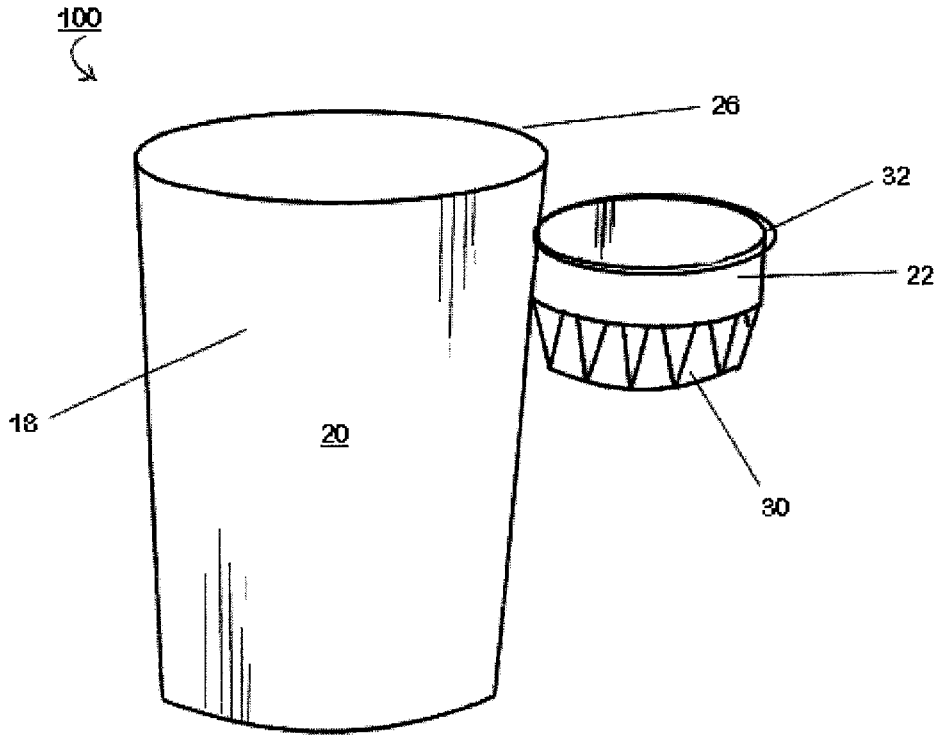
FIG. 4 A perspective view of the present invention showing a condiment container being held in loop member.
Figure 5:
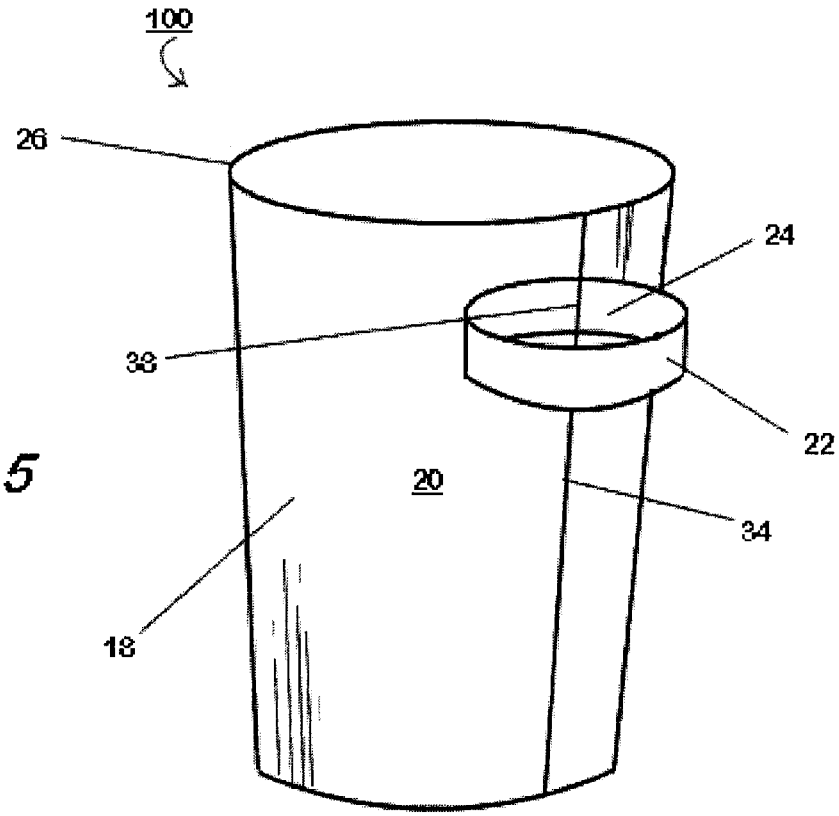
FIG. 5 A perspective view of the present invention displaying the manner in which the deployed loop member is closed at a vertical seam of the container, forming a lap joint.
Figure 6:
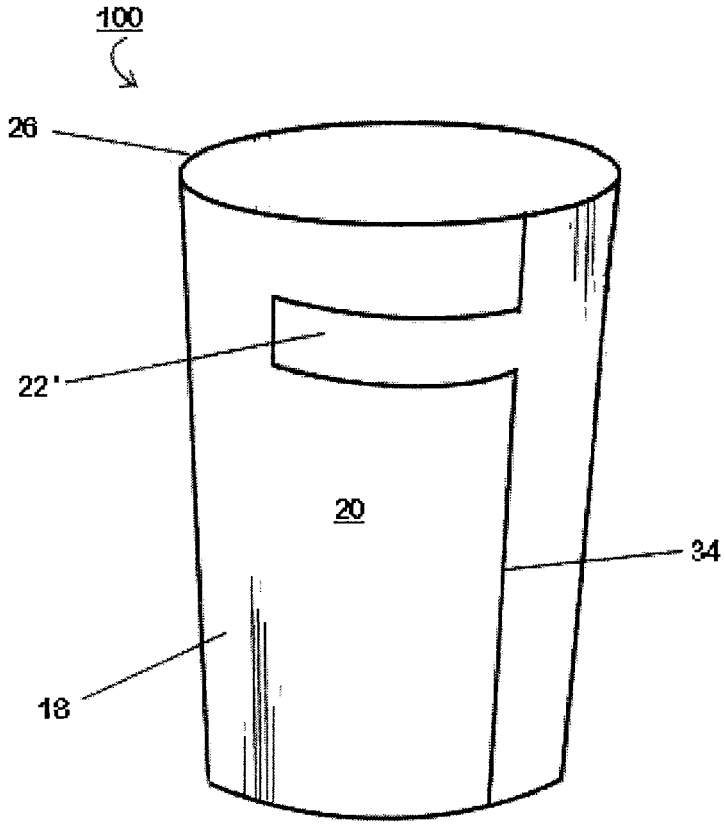
FIG. 6 A perspective view illustrating the position of closed loop member to facilitate nesting of multiple containers.
Figure 7:
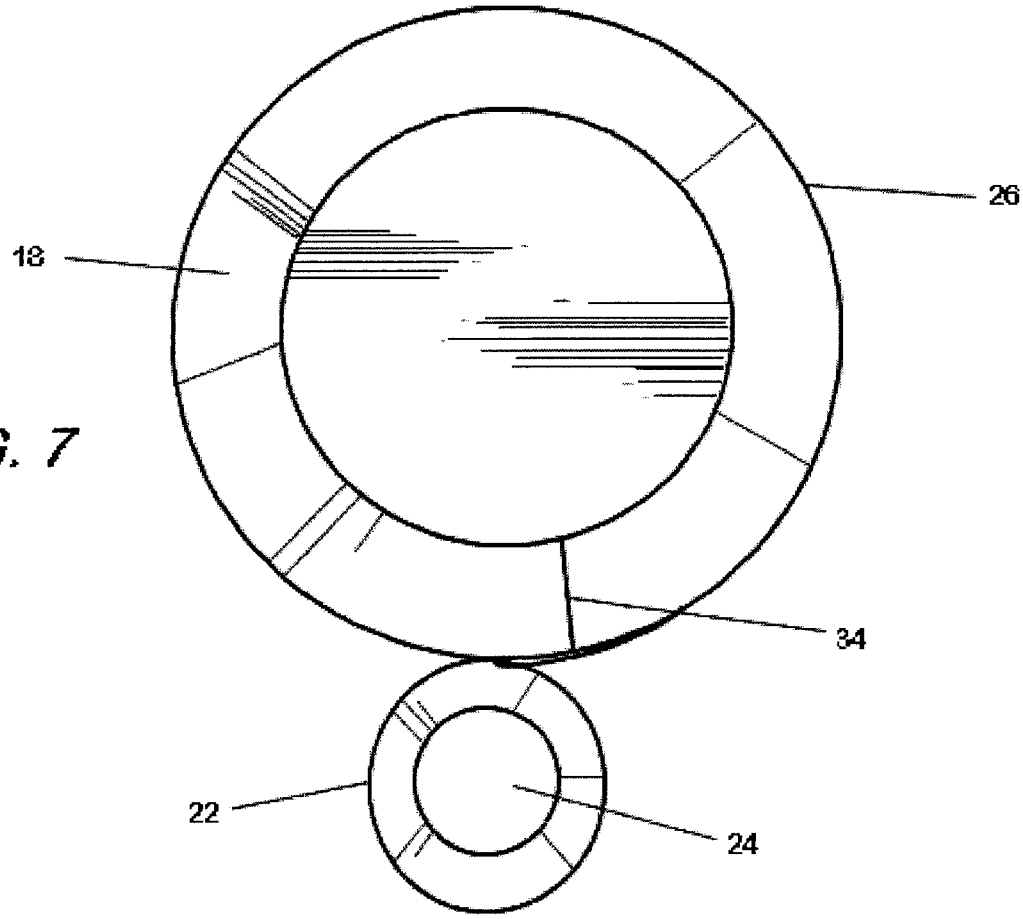
FIG. 7 A top plan view of the container showing deployed loop member, continuous lip, and vertical seam.

FIGS. 1–6 and are 13 side views of the present invention, a food container 100, which is comprised of a containing member 18 for holding a food product and a loop member 22 for supporting a condiment container. The containing member has an exterior surface 20, and continuous lip 26. The loop member 22, extends from the containing member 18 of the food container 100, and does not contact the continuous lip 26. In FIGS. 2, 3, 5, and 13 the opening 24 of the loop member 22 visibly continues throughout the loop member. FIGS. 3–4 illustrate the means by which the loop member 22 receives and supports a condiment container 30 with a lip 32. In FIG. 3, a condiment container 30 is inserted downward 28 into the opening 24 of the loop member 22. FIG. 4 shows a condiment container 30 fully inserted into the loop member 22, so that the lip of the condiment container 32 comes into contact with the loop member, supporting it against any downward pressure that may result from food being dipped into the condiment container. FIG. 5 shows the vertical seam 34 running the length of the food container 100. Also seen in FIG. 5 is the lap joint 38 where the loop member 22 is sealed at the vertical seam 34. The loop member in closed position 22', which facilitates nesting of more than one food container 100, is visible in FIG. 6. The manner in which the loop member 22', closed at the vertical seam 34, extends from the exterior surface of the food container 100 is also visible. A top view of the present invention is provided in FIG. 7. The food container 100 is shown, consisting of a containing member 18 with a continuous lip 26 and a loop member 22 with an opening 24 that is closed at a vertical seam 34.

Figure 8:
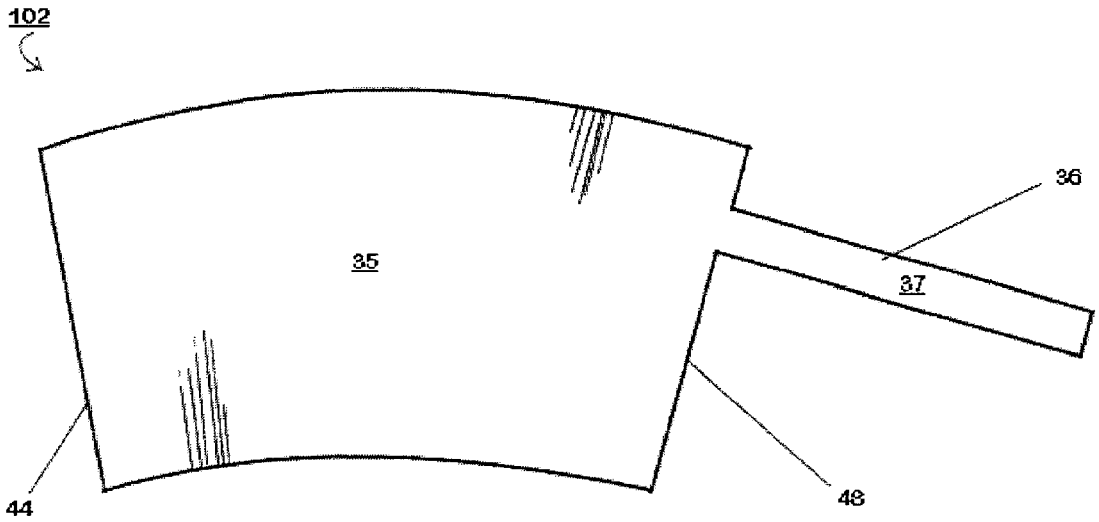
FIG. 8 A plan view of a single blank used to form the container.
Figure 9:
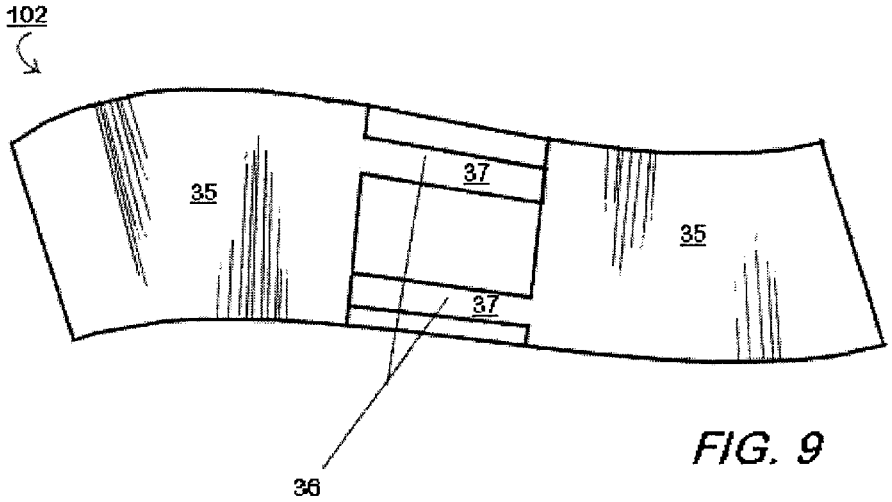
FIG. 9 A plan view of two interconnected blanks as would be employed using the existing method of container production.
Figure 10:
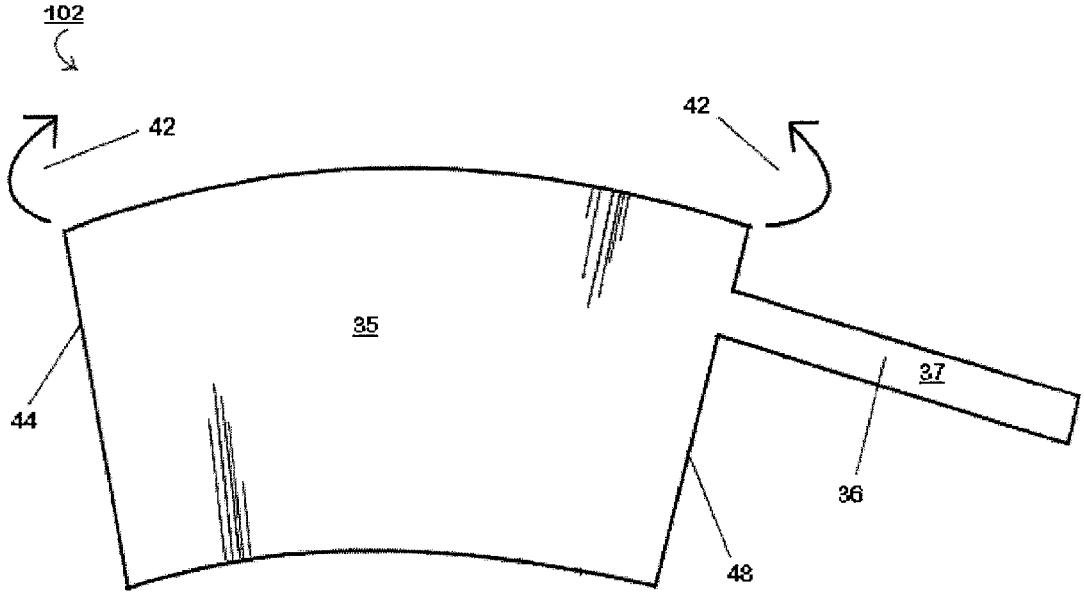
FIG. 10 A front perspective view of the first step in container formation from a blank.
Figure 11:
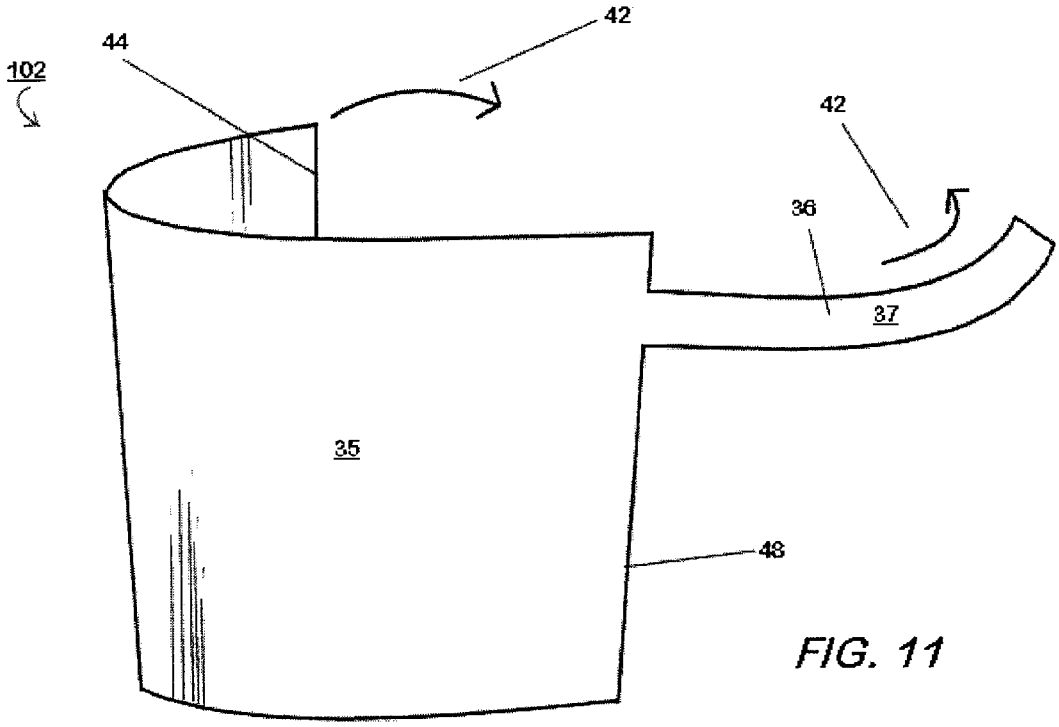
FIG. 11 A front perspective view of the second step in container formation.
Figure 12:
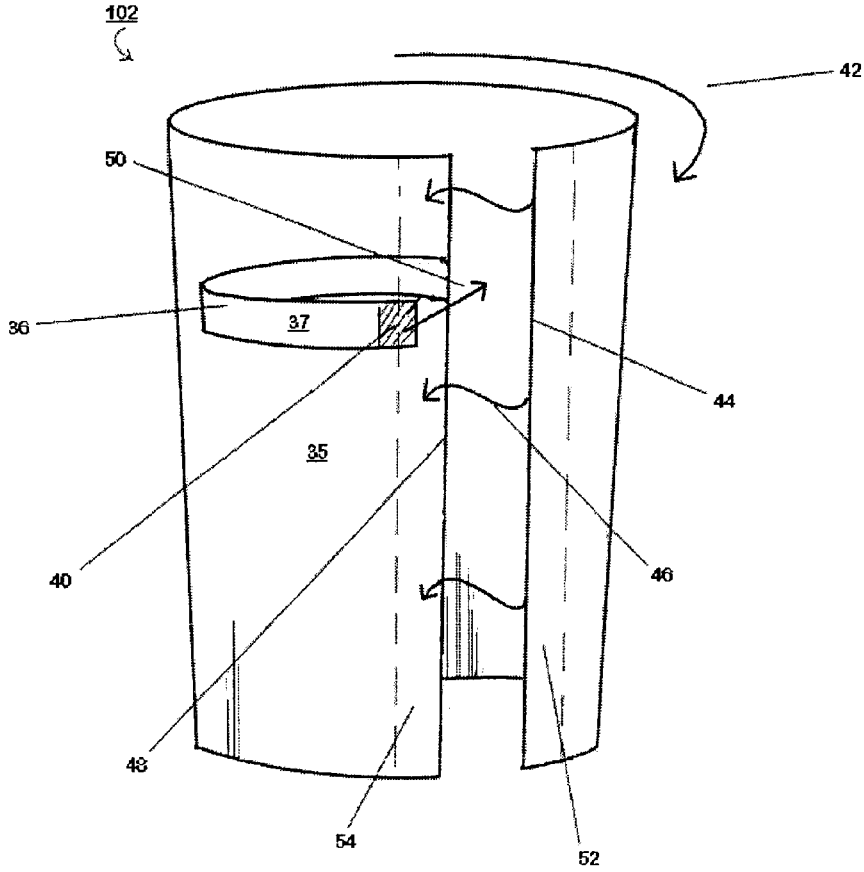
FIG. 12 A front perspective view of the third step in container formation.
Figure 13:
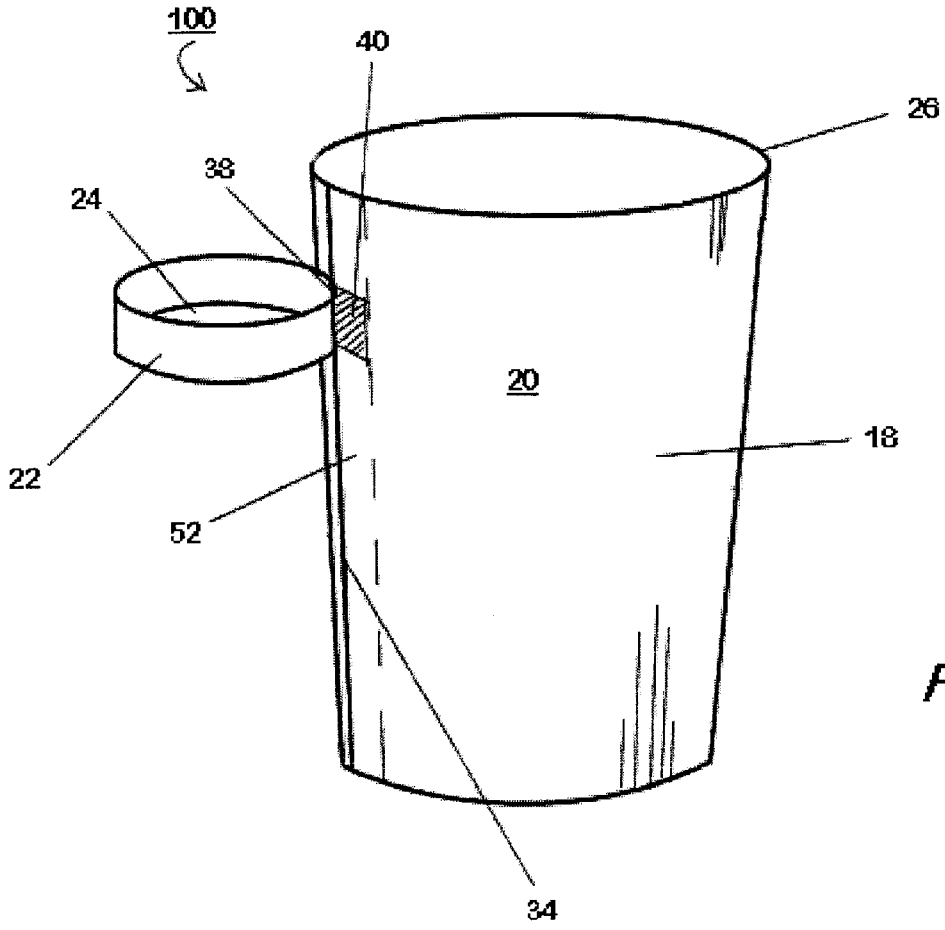
FIG. 13 A perspective view illustrating the completed container and the structure of the lap joint.

FIGS. 8–9 illustrate the flat blank 102 from which the present invention is formed. FIG. 8 shows a single blank with a first portion 35 and a distinct second portion 37 comprised of an integral strip 36. FIG. 9 depicts two blanks 102 arranged in formation consistent with the current manufacturing process of similar food containers. The first portion 35 and second portion 37 with integral strip 36 are visible on each blank. FIGS. 10–13 show precisely how the food container 100, seen in FIGS. 1–7 and 13, is formed from a blank. In FIG. 10 the end 48 of the first portion 35 of the blank 102 from which the second portion 37 with integral strip 36 extends and the end 44 of the first portion from which the strip does not extend are curled towards one another 42. FIG. 11 represents a continuation of this process. In addition to the end 48 of the first portion 35 of the blank 102 from which the distinct second portion 37 with integral strip 36 extends being curled towards the end 44 of the first portion of the blank from which the strip does not extend, the integral strip 36, is also curled inwards, beginning to form the loop member 22 (FIGS. 1–7 and 13). The direction opposite that in which the ends 44, 48 of the first portion 35 of the blank 102 are moved towards one another forms the exterior surface 20 of the container. The final step in forming the present invention from a blank is illustrated in FIG. 12. The first portion 35 of the blank 102 is curled 42 completely so that the end of the blank 44 is joined 46 with the end of the blank 48 so that an area 52 of the side of the first portion 35 of the blank 102 from which the second portion 37 with integral strip 36 does not extend overlaps an area 54 of the side of the first portion of the blank from which the second portion with integral strip does extend. This overlap creates a vertical seam 34, as seen in FIGS. 5–7, 12, and 13 and forms a containing member 18 (FIGS. 1–7 and 13) from the first portion 35 of the blank 102. The free end 40 of the integral strip 36, part of the second portion 37 of the blank 102 is formed into a loop member 22 (FIGS. 1–7 and 13) by joining 50 the free end 40 between areas 52 and 54 to form a vertical seam 34 (FIGS. 5–7, and 13). FIG. 13 shows the free end 40 affixed underneath the portion 52 of the side of the first portion 35 of the blank 102 from which the second portion 37 with integral strip 36 does not extend, creating a lap joint 38. The loop member 22, formed from the distinct second portion 37 of the blank 102 is sized to fit a condiment container 30 (FIGS. 3–4).

While the food container depicted in these drawings is cylindrical, such containers come in a variety of shapes. The present invention can be embodied in any food container that is cut from a continuous blank and contains a vertical seam.

Various changes could be made in the above construction and method without departing from the scope of the invention as defined in the claims below. It is intended that all matter contained in the above description as shown in the accompanying drawings shall be interpreted as illustrative and not as a limitation.

We claim:

1. A food container comprising:

(a) a container member having an exterior surface and formed from a first portion of a blank, the container member having a continuous lip; and (b) a loop member formed from a second portion of the blank and distinct from the first portion of the blank and extending from the exterior surface of the container and in which no part of the loop member contacts the lip, the loop member opened throughout an entire longitudinal length of the loop, the loop member forming an opening to receive a condiment container.

2. A food container as recited in claim 1 wherein the container member has a vertical seam and in which the loop member is closed at the seam.

3. A food container as recited in claim 2 wherein the loop member is closed at the seam by binding an end of the loop to the seam to form a lap joint at the seam.

4. A food container as recited in claim 1 wherein the loop member has a condiment container inserted into the loop member and supported by the loop member.

5. A method for making a food container having an integral condiment container comprising:

(a) providing a flat container blank having an integral strip of blank material extending from the blank and below a top edge of the container blank;

(b) forming the container blank into a container and joining the ends of the container blank to form a vertical seam along the container; and (c) forming the integral strip into loop and joining a free end of the strip at the seam to form a lap joint with the container seam and the free end of the integral strip, the loop opened and sized to receive and support a condiment container for the food container, the loop member opened throughout an entire longitudinal length of the loop.

* * * * *